US007100317B1

(12) United States Patent
Strong

(10) Patent No.: US 7,100,317 B1
(45) Date of Patent: Sep. 5, 2006

(54) DISPLAY DEVICE AND PHOTO HOLDER

(76) Inventor: Finn Alexander Strong, 151 Tamal Vista Dr., San Rafael, CA (US) 94901

( * ) Notice: Subject to any disclaimer, the term of this patent is extended or adjusted under 35 U.S.C. 154(b) by 141 days.

(21) Appl. No.: 10/688,571

(22) Filed: Oct. 18, 2003

(51) Int. Cl.
*G09F 1/00* (2006.01)

(52) U.S. Cl. ..... 40/124.07; 40/124.19; 40/738; 40/729; 40/777

(58) Field of Classification Search ..... 40/124.07, 40/127.19, 743, 738, 729, 730, 777, 734; 248/473, 488
See application file for complete search history.

(56) References Cited

U.S. PATENT DOCUMENTS 1,435,762 A * 11/1922 Tomsich ..... 40/777
2,160,724 A 5/1939 Fletcher
2,428,772 A 10/1947 Aranoff
2,532,132 A * 11/1950 Vogel ..... 40/124.4
2,862,322 A 12/1958 Ziegler
2,873,545 A 2/1959 Noel
3,234,676 A 2/1966 Colicki
5,822,896 A 10/1998 Milstein
6,173,515 B1 1/2001 Walsh
6,449,891 B1 9/2002 Miska
6,718,676 B1 * 4/2004 Miska ..... 40/789

* cited by examiner

*Primary Examiner*—Cassandra Davis
(74) *Attorney, Agent, or Firm*—Bill & Mary Lou Inc.; William Keyworth

(57) ABSTRACT

A thin flexible material (30) is die-cut into a shape. Inset cuts are made in the sheet material to form large tabs (32 and 32') and small tabs (34 and 34'). Another set of inset cuts and a vertical cut are made to form split tabs (40*a* and 40*b* and 40'*a* and 40'*b*). The large tabs are bent forward and the small tabs are bent backward so that a photo or flexible sheet material (46) may be placed under tabs in a flexed position on both sides of the device in either a horizontal or vertical orientation. The curved position of the displayed material creates a unique effect without damaging the displayed material with tacks or tape. When assembled the display device and displayed materials form a stand-alone three-dimensional structure. When placed on a horizontal surface, the displayed material can be displayed on both sides of the device. With displayed material on only one side of the device, it can be attached to a vertical surface. When not assembled, the structure, consisting of the display device and the displayed material, can store flat or fit in an envelope.

9 Claims, 6 Drawing Sheets

PHOTO STRIP
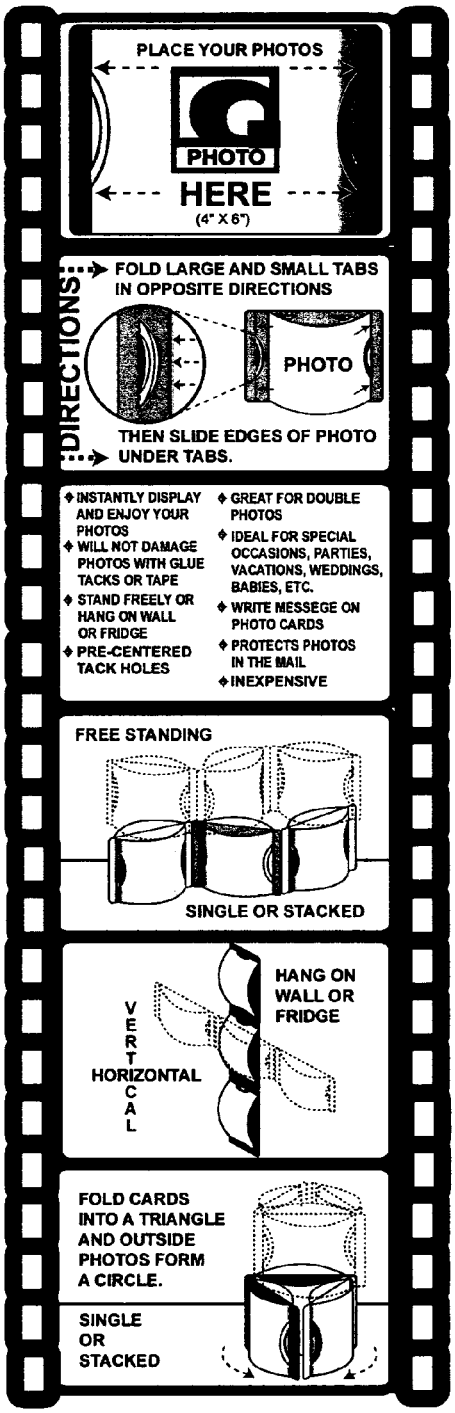
FIG.29-A
PHOTO CARDS
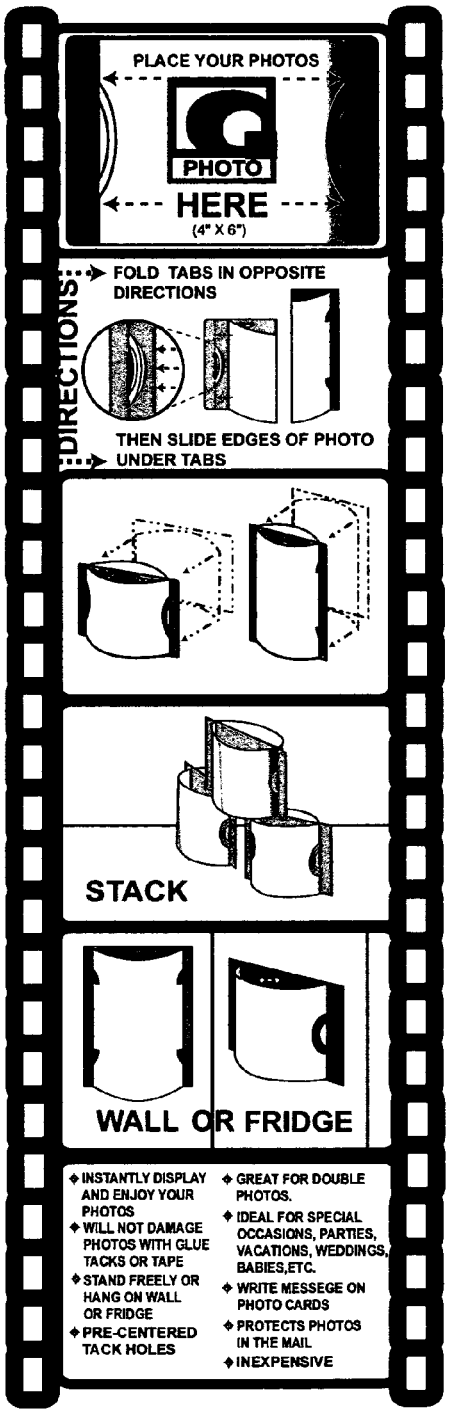
FIG.29-B

DISPLAY DEVICE AND PHOTO HOLDER

CROSS-REFERENCE TO RELATED APPLICATIONS

None

FEDERALLY SPONSORED RESEARCH

None

SEQUENCE LISTING OR PROGRAM

None

BACKGROUND OF INVENTION—FIELD OF INVENTION

This invention relates to an inexpensive three-dimensional display device that can be used to display photographs, cards, and other paper-like or flexible sheet materials.

BACKGROUND OF INVENTION—PRIOR ART

There are a variety of three-dimensional display devices that can be used to display photographs, cards, and other paper-like materials. Many of the current three-dimensional display devices are made from several different types of materials, have multiple folds and cuts, and require glues and adhesives for assembly therefore making them more expensive to manufacture and more complicated for the end-user to assemble.

Many of these display devices also lack versatility. The material being displayed can only be displayed on one side of the device, not both, and can only be placed in a set orientation (i.e. horizontal or vertical), not both. Also the devices are only meant for table-top display or wall display, not both.

Many of the current display devices copy the classic picture frame model where the displayed material is surrounded and the edges of the displayed material are placed behind an overlapping frame. These display devices lack a unique presentation of the material being displayed and do not utilize the displayed material as a means of support.

For example, U.S. Pat. No. 2,428,772 issued to Aranoff in 1947 creates a recessed picture display device where the displayed material is only viewable from one side and the device cannot display items on both of its sides.

Display frame structure, U.S. Pat. No. 2,862,322 issued to Ziegler in 1958, shows a frame structure for recessed viewing of a display item. A window cut in the frame structure makes the displayed material viewable from only one side. In addition, the displayed material is held in a raised fashion by a cut and bend in the frame structure causing it to tilt backward. This feature prevents the frame from being stacked or hung on a wall.

The Diorama Card with Pop-up, U.S. Pat. No. 6,173,515 issued to Walsh in 2001, and the Dioramic Greeting Card, U.S. Pat. No. 5,822,896 issued to Milstein in 1998, are three-dimensional and collapsible display devices but are complex to manufacture and assemble with several different overlapping panels. They both are also only one-sided display devices.

U.S. Pat. No. 2,160,724 issued to Fletcher in 1939 uses the display device to stretch the display material so that it is wrinkle free and flat. The means of attachment is a series of folds in the display material which are then tucked under tabs on the display device. The multiple folds in the display material cause damage and make it difficult to use the display material again. Also, since it uses the curve of the display device as the means of support, display material can only be displayed on one side of the device.

The presentation apparatus for artwork, described in U.S. Pat. No. 6,449,891 issued to Miska in 2002, is made of one piece of cardboard, die-cut to create a folder construction. This apparatus although curved to create a stand-alone structure, uses an overlapping frame with an acetate window for viewing artwork on the back section. It uses more than one type of material and includes multiple folds therefore making it more expensive to manufacture.

BACKGROUND OF INVENTION—OBJECTS AND ADVANTAGES

Several objects and advantages of this invention are:

(a) to provide an inexpensive, simple to manufacture, and simple to assemble display device that can quickly and attractively display a photograph, card, or other paper-like material;

(b) to provide the display device as described, that is constructed from only a single sheet of flexible material;

(c) to make the display device as described using minimal cuts, minimal score lines, and no complicated folds in the manufacturing process;

(d) to be able to hold displayed material, such as a photograph, card, or other paper-like material, on one or both sides of the display device;

(e) to hold the displayed material in a unique, curved, and flexed position in the display device, so when the displayed material and display device are combined they create a stable, stand-alone, and three-dimensional structure;

(f) to be able to hold the displayed material in either a horizontal or vertical position in the display device depending on the orientation of the displayed material;

(g) to be able to display the displayed material in combination with the display device on a horizontal or vertical surface;

(h) to be able to stack the three-dimensional structures, resulting from the combination of the display device and displayed material, on top of each other to form a vertical tower-like structure when on a horizontal surface;

(i) to not harm the displayed material with tacks or tape when on a vertical surface (any tacks or tape would be attached to the display device not the displayed material);

(j) to provide a convenient display system that can be mailed or stored flat and then quickly and simply set up into a three-dimensional display without any additional materials;

(k) to provide even hanging on vertical surfaces, with pre-centered holes or marks;

(l) to provide a multiple-panel display device capable of single-sided or double-sided display;

(m) to provide several display devices connected by perforation for optional separation;

(n) to provide various configurations for multiple-sized displayed materials;

(o) to combine several display devices using wire or string to create a mobile or sculpture; and (p) to provide a template printout of several display devices created by a computer software program.

Other objects of this invention will appear in the specifications and will be apparent from the accompanying drawings.

SUMMARY

The present invention provides a device for the display of photographs or other flexible sheet materials. The display device is formed from a single sheet of flexible material such as card stock. The display device is simple and inexpensive to produce and is easy to assemble for the end-user. The photograph, card, or other displayed material is held in a fixed, flexed, and curved position in either a horizontal or vertical orientation. When assembled the display device and the displayed material form a stand-alone three-dimensional structure that can be placed on a horizontal surface or attached to a vertical surface for display. When on a horizontal surface, the displayed material can be held and displayed on both sides of the holder. The entire structure can be stacked on top of a duplicate structure to form a vertical tower-like structure. When attached to a vertical surface, such as a refrigerator, wall, or bulletin board, the curved position of the displayed material creates a unique effect without damaging the display material with tacks or tape. When not assembled, the structure, consisting of the display device and the displayed material, can store flat or fit in an envelope.

DRAWINGS—FIGURES

FIGS. 29-A and 29-B show instructional materials that could accompany the display device.

Figure 30:
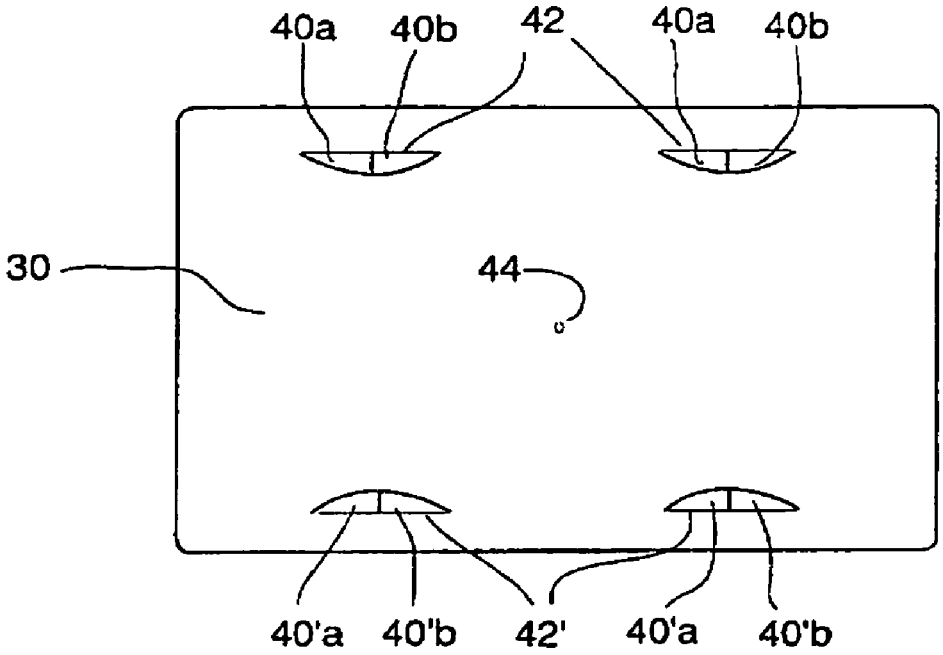

FIG. 30 is a front view of the display device using split tabs.

DRAWINGS—REFERENCE NUMERALS

| | |
|---|---|
| 30 sheet | 42 and 42' crease or score |
| 32 and 32' large tab | 44 pre-centered hole or mark |
| 36 and 36' small tab | 46 and 46' photograph, card, or other paper-like display material |
| 38 and 38' crease or score | |
| 40a, 40b, 40'a and 40'b split tab | |

DETAILED DESCRIPTION—PREFERRED EMBODIMENTS

Figure 1:
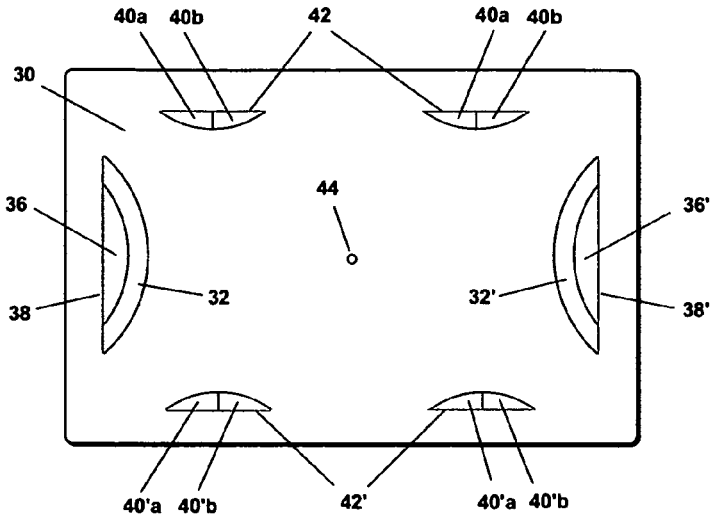
FIG. 1 is a front view of the display device.

A preferred embodiment of the present invention is illustrated in FIGS. 1–4. Referring to FIG. 1, a card or sheet material 30 is cut into a rectangular shape sized so the edges are pre-determined. Inset from the edges, adjacent curved cuts or slits are made in card 30 to form opposing large tabs 32 and 32' and small tabs 36 and 36'. A straight crease 38 and 38' is located at the end of the curved cuts or slits to define large tabs 32 and 32' and small tabs 36 and 36'. Another set of curved cuts or slits and a vertical cut are made to form opposing split tabs 40*a* and 40*b* and split tabes 40'*s* and 40'*b*. A straight crease 42 and 42' is located at the end of the curved cuts or slits to define split tabs with halves 40*a* and 40*b* and split tabs with halves 40'*a* and 40'*b*. A pre-centered hole or mark 14 is centrally located as a reference for even-hanging on vertical surfaces.

Figure 2:
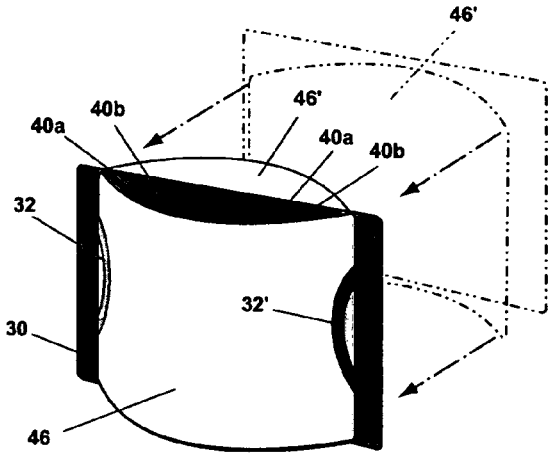
FIG. 2 is a perspective view of the assembled display device in the horizontal configuration.

Shown in FIG. 2, large tabs 32 and 32' are bent forward and small tabs 36 and 36' are bent backward so that a photo or flexible sheet material 46 and 46' may be placed under tabs 32 and 32' and tabs 36 and 36' in a flexed curved position on both sides of card 30. Phantom lines show the bending of photo 46'.

Figure 3:
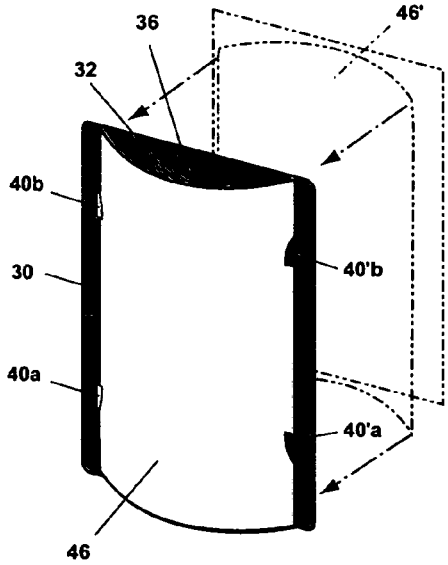
FIG. 3 is a perspective view of the assembled display device in the vertical configuration.

FIG. 3 shows card 30 assembled in a vertical position utilizing split tabs 40*a* and 40*b* and 40'*a* and 40'*b* to hold photo 46 and 46' in a flexed and curved position. Phantom lines show the bending of photo 46'.

Figure 4:
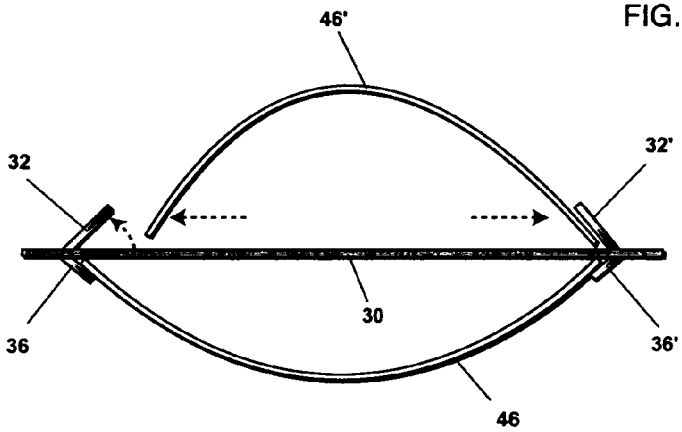
FIG. 4 is a top view of the display device with the right side assembled and the left side being assembled.

FIG. 4 shows a top view of card 30 with tabs 32 and 32' and tabs 36 and 36' bent and extended in opposite directions along crease 38 and 38'. In this position tabs 32 and 32' and tabs 36 and 36' catch and pinch the edges of photo 46 and 46' while holding the photo 46 and 46' in a flexed and curved position.

OPERATION—PREFERRED EMBODIMENTS

A preferred embodiment of the present invention is illustrated in FIGS. 1–4. The display device is rectangular in shape and is constructed from a thin and flexible sheet of material such as card stock. For this example, in FIG. 1, the display device 30 is 4 inches by 6 inches, the same proportions as a standard photograph. A series of inset tabs are die cut into the thin and flexible sheet of material to form opposing tabs 32 and 32' and tabs 36 and 36' and scores 38 and 38'. When these tabs are bent in opposite directions (large tabs 32 and 32' bent towards viewer and small tabs 36 and 36' bent away from viewer), as in FIG. 2, they form a stop or barb that holds photo 46 and 46' in a bowed, flexed, or curved position on both sides of card 30. In addition, as seen in FIG. 4, the edge of photo 46 and 46' is pinched where tabs 32 and 32' and tabs 36 and 36' intersect with the base to hold it more securely. This configuration creates a free-standing three-dimensional structure with minimal materials that utilizes the displayed material as a means of support. If a vertical image is to be displayed, as in FIG. 3, simply bend split tabs 40*a* and 40*b* and split tabs 40'*a* and 40'*b* in opposite directions, slide photo 46 underneath tabs and stand the device in a vertical fashion.

The display device can also be mounted on a vertical surface such as a wall, refrigerator, or bulletin board. When mounted on a vertical surface, displayed material can only be displayed on one side of the device, as in FIG. 3. Bend the selected tabs and use a tack, tape, or magnet to attach the display device to the vertical surface. Use pre-centered hole or mark 14 for even and level hanging when using tacks, tape, or magnets. Once the display device is in place, slip photo 46 under the selected opposing tabs.

DETAILED DESCRIPTION—ADDITIONAL EMBODIMENTS

Figure 5:
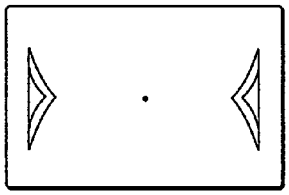
FIGS. 5 and 6 show other possible double-sided tab styles.
Figure 6:
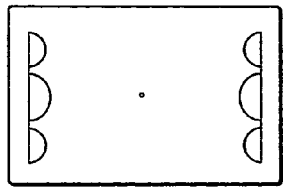
Figure 7:
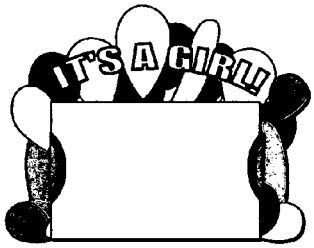
FIG. 7 is a view of an alternate display device shape.
Figure 8:
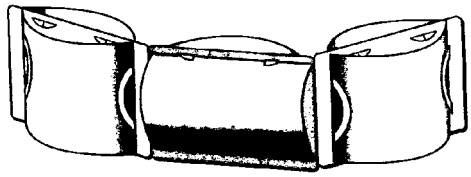
FIG. 8 shows a strip display device where three devices are constructed together.
Figure 9:
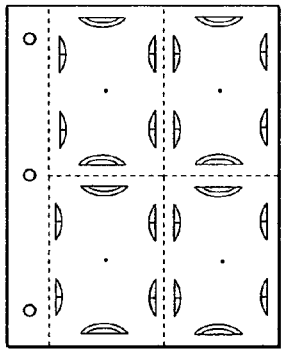
FIG. 9 shows a perforated binder version.
Figure 10:
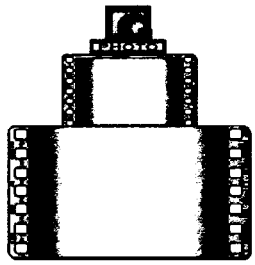
FIG. 10 is a view of a combination display device that holds various sizes of displayed material.
Figure 11:
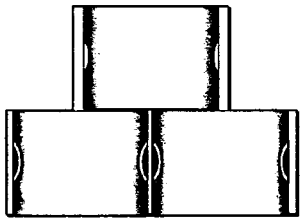
FIG. 11 shows a pyramid shaped display device, holding multiple display materials.
Figure 12:
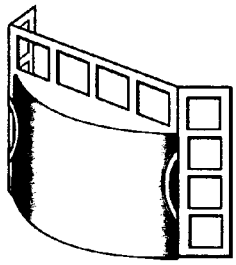
FIG. 12 shows a display device with a bendable and decorative border.
Figure 13:
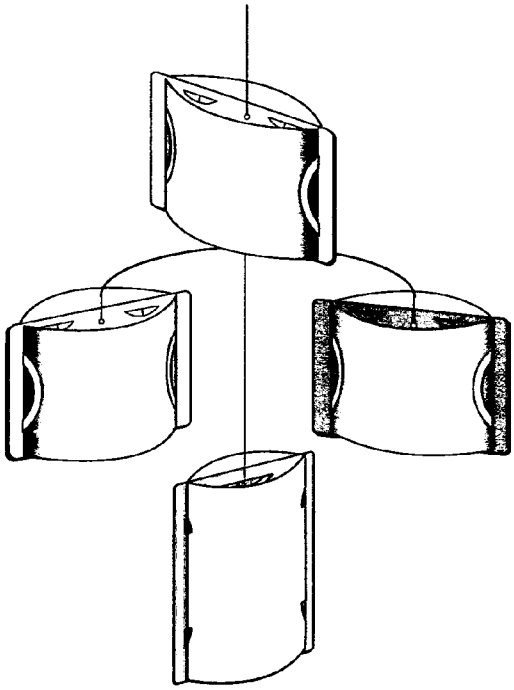
FIG. 13 shows multiple display devices connected by string and or wire to form a mobile or sculpture.
Figure 14:
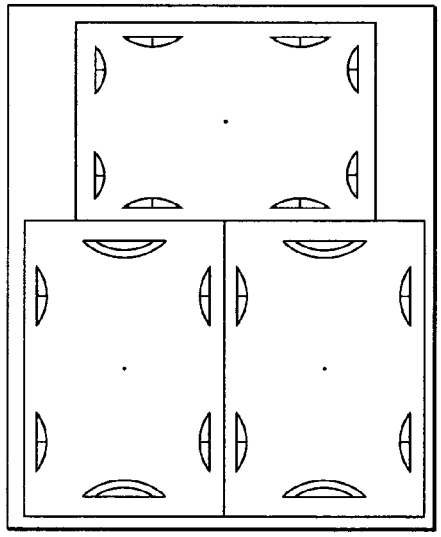
FIG. 14 shows a printout of a display device template created by computer software.
Figure 15:
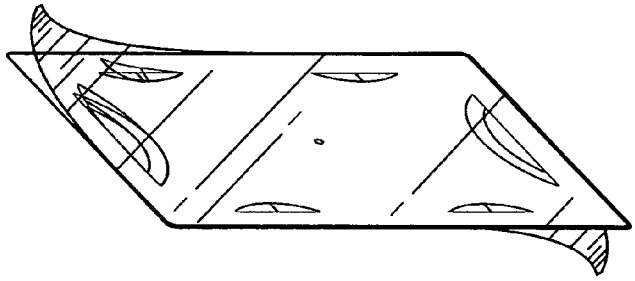
FIG. 15 shows a layer of laminate or tackifier on each side of the display device.
Figure 16:
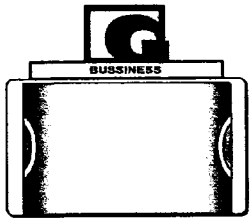
FIGS. 16–21 and FIGS. 23–28 show other various alternative shapes and designs.
Figure 17:
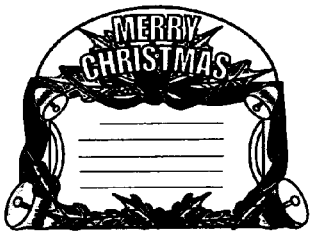
Figure 18:
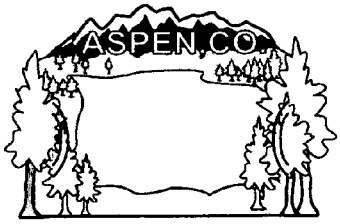
Figure 19:
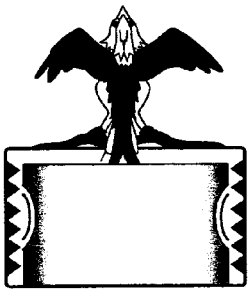
Figure 20:
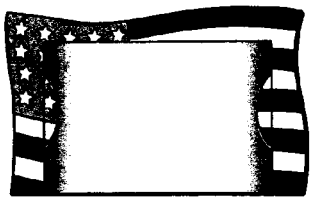
Figure 21:
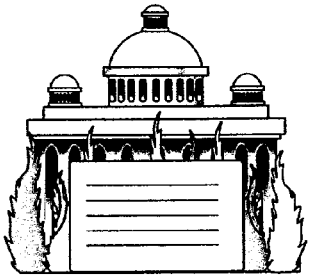
Figure 23:
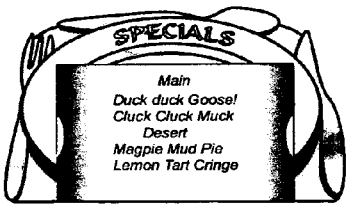
Figure 24:
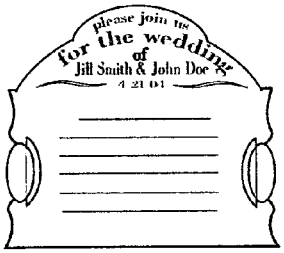
Figure 25:
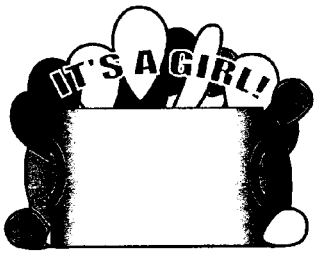
Figure 26:
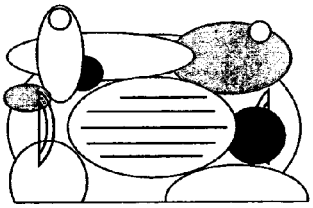
Figure 27:
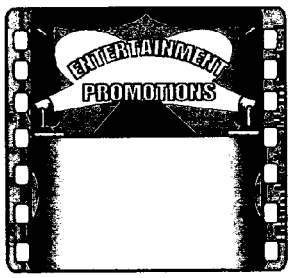
Figure 28:
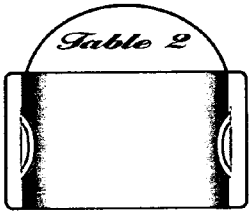

Additional embodiments are shown in FIGS. 5–21 and FIGS. 23–28. FIGS. 5 and 6 illustrate two different possible adjacent tab styles capable of double-sided display. Instead of curved cuts to form the large tabs as in the preferred embodiment, the cuts are made of ½ diamonds or a series of ½ circles. FIG. 7 illustrates one of the many possible shapes of the display device. FIG. 8 shows three display devices cut from one strip of flexible sheet material. Score lines are made between each of the display devices to allow the entire strip to bend along the different score lines. In FIG. 9, four of the display devices are die-cut into a binder sheet that would fit into a three-ring binder for various albums or books. Perforated edges separate each of the display devices. FIG. 10 shows a combination of two display devices, capable of holding different-sized displayed materials. In FIG. 11, one display device is shown that is capable of holding three pieces of displayed material. FIG. 12 shows a display device with an extended and decorative border die-cut around the device. Score lines are made on each side of the device so the edges can be bent in a controlled fashion from the main part of the display device. FIG. 13 shows several display devices connected by strings and/or wires to form a mobile or sculpture. FIG. 14 shows a template of three 4"×6" display devices printed on standard 8.5"×11" paper supplied by a software program or computer. FIG. 15 shows a layer of laminate or tackifier affixed to each side of the display device. A tackifier is a releasable adhesive. FIGS. 16–21 and FIGS. 23–28 illustrate some of the many possible designs and shapes of the display device that relate to the content of the photograph, card, or other paper-like material displayed.

OPERATION—ADDITIONAL EMBODIMENTS

The display device can be used for various purposes including displaying paper-like display materials such as photographs, holiday greetings or wedding invitations, entertainment venue reminders, or special items on restaurant menus, business cards, and table seat cards. Paper-like display materials are capable of the flexed, curved position as shown in FIG. 4. Additional embodiments of the present invention are illustrated in FIGS. 5–21 and FIGS. 23–28. The display device can have several different tab styles, capable of displaying the displayed material on both sides of the display device. Also the display device can be manufactured into several different shapes that can display on table-tops or be mounted on a wall. The strip version, in FIG. 8, is capable of displaying six pieces of displayed material on a tabletop or three when on a wall or refrigerator. The displayed material can be held in different orientations depending on which tabs are used. The perforated binder version, in FIG. 9, could be part of a photo album. The user could tear out the display devices from the binder sheet and have four display devices in which they could show their photographs. In FIG. 10, a business card and a photograph could be displayed together in the combination display device. FIG. 11 shows one device that is capable of holding three pieces of display material. In FIG. 12, one version of a decorative border is shown with bent sides to add stability and dimension when only one piece of displayed material is shown. FIG. 13 shows display devices arranged as a mobile using strings or wires. FIG. 14 shows three display devices on a template printout from a computer software program. The user could use the software program to create their own display devices and print them on their home printer. FIG. 15 shows a layer of laminate or tackifier attached to each side of the display device to provide more grip on the displayed material.

FIGS. 16–21 and FIGS. 23–28 demonstrate a few of the possible shapes that relate to the photograph, card, or other paper-like material displayed and shows the markets the display device could span.

CONCLUSIONS, RAMIFICATIONS, AND SCOPE

The reader will see that the display device described in this invention has many advantages including the following:

- it uses minimal material;
- it is simple and inexpensive to manufacture;
- it is inexpensive for the end-user to buy;
- it is quick and easy to assemble for the end-user;
- it provides many different ways to display photographs, cards and other paper-like materials, either in a horizontal or vertical position depending on the orientation of the displayed material;
- it can display material on one or both sides of the display device;
- it can be displayed either on a table-top or mounted on a wall;
- it creates a unique visual effect by holding the displayed material in a curved and flexed position;
- it creates a stable stand-alone three-dimensional structure for display;
- it can be mailed or stored flat and then quickly and simply set up into a three-dimensional display without any additional materials;
- it does not harm the displayed material with tacks or tape; and
- it includes one or several pre-centered holes or marks that are centrally located for even-hanging on vertical surfaces.

Although the description above contains many specifics, these should not be construed as limiting the scope of the invention, but instead as merely providing illustrations of some of the presently preferred embodiments of this invention. For example, the display device can have many different shapes beyond the ones described here, the tabs can be in several different shapes and orientations, and the device can be made from other flexible materials besides card stock.

Thus the scope of the invention should be determined by the appended claims and their legal equivalents.

I claim:

1. A display device for displaying one or more photograph or card display material of known dimension, rectangular shape, and sized so the opposing edges are pre-determined comprising:

a. a sheet having a first side and a second side and pre-determined opposing edges;

b. a plurality of opposing large tabs inset from opposing edges of the sheet;

c. a plurality of small tabs each arranged adjacent to one of the plurality of opposing large tabs;

d. a first and second split tab, with a first half and a second half, cut into the sheet such that each half of each split tab bends to the first or second side of the sheet, and each arranged inset from the opposing edges of the card that are transverse to the edges adjacent to the large tabs and small tabs; and e. the large tabs, the small tabs, and the first and second split tabs further arranged such that the tabs are closer together than a photograph or card display material of known dimension wherein a first photograph or card display material is engaged in a curved position on the first side of the sheet and simultaneously a second photograph or card display material is engaged in a curved position on the second side of the sheet.

2. The display device of claim 1 further comprising the display device pre-determined opposing edges are arranged in a shape that relates to the photograph or card displayed.

3. The display device of claim 1 further comprising said tabs are varied in shape.

4. The display device of claim 1 further comprising multiple display devices joined by attachments selected from the group consisting of strings and wires.

5. The display device of claim 1 further comprising one or more centrally located marks or holes for hanging.

6. The display device of claim 1, further comprising two or more display devices are connected such that a multiplicity of display materials are engaged.

7. The display device of claim 1 further comprising two or more display device edges are connected by perforations.

8. A display device for displaying one or more photograph or card display material of known dimension rectangular shape, sized so the opposing edges are pre-determined comprising:

a. a sheet having a first side and a second side and pre-determined opposing edges;

b. a plurality of opposing large tabs inset from opposing edges of the sheet, and arranged such that the large tabs are closer together than a photograph or card display material dimension;

c. a plurality of small tabs each arranged adjacent to one of the plurality of opposing large tabs and arranged such that the small tabs are closer together than the photograph or card display material dimension, wherein the large tabs are arranged to engage a first photograph or card in a curved position on the first side of the sheet and the small tabs are arranged to simultaneously engage a second photograph or card display material in a curved position on the second side of the sheet; and d. two or more display device edges are connected by perforations.

9. A versatile display device for one or more photograph or card display material of known dimension comprising:

a. a sheet having a first side and a second side and pre-determined opposing edges;

b. a plurality of opposing split tabs cut into the sheet and arranged such that each half of the split tab bends to the first or second side of the sheet and further arranged such that the split tabs are closer together than a photograph or card display material dimension, and the first half of each split tab arranged to engage a first photograph or card display material in a curved position on one side of the sheet and the second half of each split tab arranged to simultaneously engage a second photograph or card display material in a curved position on the opposite side of the sheet; and c. two or more display edges are connected by perforations.

* * * * *